United States Patent [19]

Linder

[11] Patent Number: 4,486,288

[45] Date of Patent: Dec. 4, 1984

[54] OXIDE ANODE FOR USE IN IMPRESSED CURRENT CATHODIC CORROSION PROTECTION

[76] Inventor: Björn H. Linder, 225 Strandvägen, S-26161 Landskrona, Sweden

[21] Appl. No.: 357,289

[22] Filed: Mar. 11, 1982

[51] Int. Cl.[3] ..... C23F 13/00

[52] U.S. Cl. ..... 204/196; 204/291

[58] Field of Search ..... 204/147, 148, 196, 197, 204/291

[56] References Cited

U.S. PATENT DOCUMENTS

| | | | |
|---|---|---|---|
| 2,508,171 | 5/1950 | Kaufman | 204/197 |
| 3,497,443 | 2/1970 | Von Bursdorff | 204/196 |
| 3,923,625 | 12/1975 | Fischer et al. | 204/420 |
| 4,096,051 | 6/1978 | Annis et al. | 204/196 |
| 4,175,021 | 11/1979 | Tatum et al. | 204/196 |

OTHER PUBLICATIONS

Linder, *Materials Performance,* Aug. 1979, pp. 17–20.

*Primary Examiner*—T. Tung

*Attorney, Agent, or Firm*—Synnestvedt & Lechner

[57] ABSTRACT

An improved oxide anode for use in impressed current cathodic corrosion protection, comprising a metal oxide anode member, preferably a magnetite anode member, having a coating or plating consisting of an electrically conductive metal or metal alloy, said coating or plating being connected to an electrically conductive cable termination which is fixed in a central position relative to said coating or plating.

9 Claims, 1 Drawing Figure

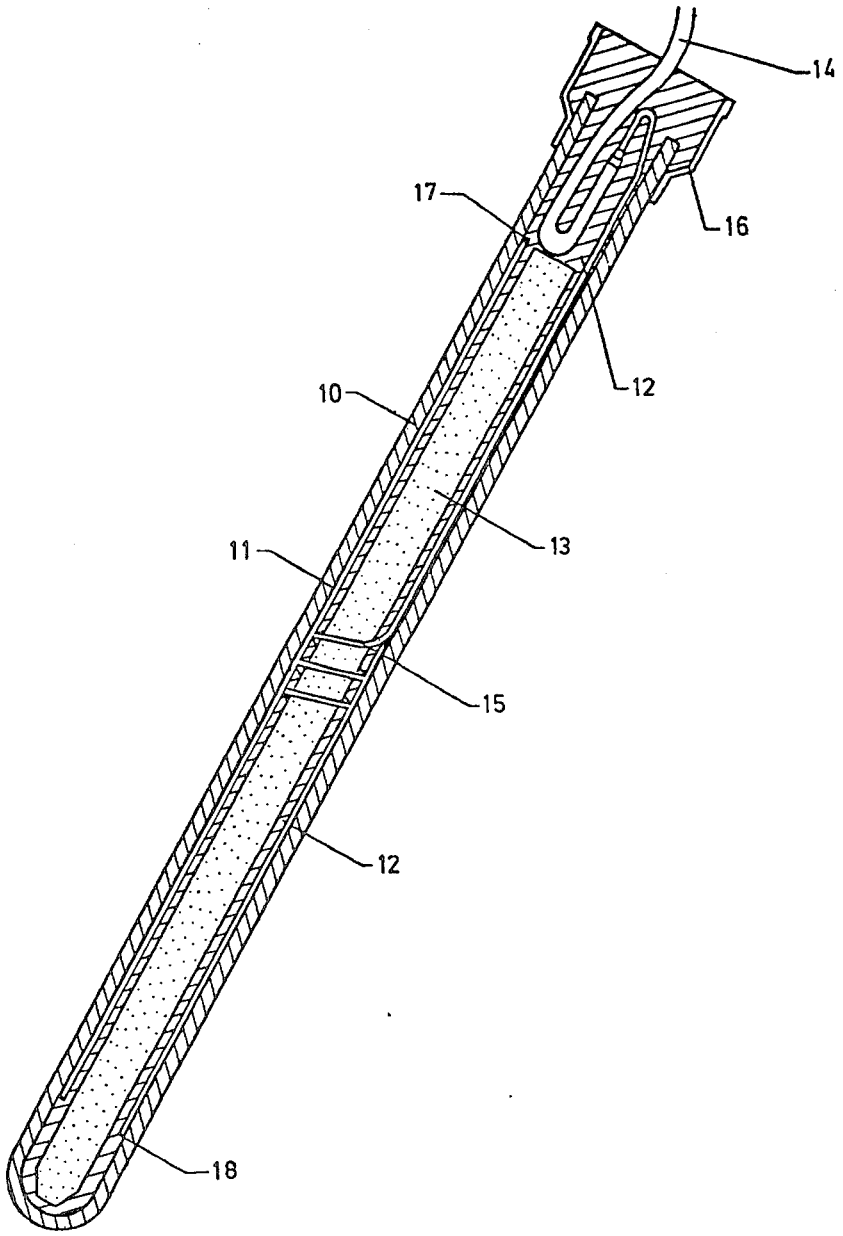
14
17
16
12
10
13
11
15
12
18

OXIDE ANODE FOR USE IN IMPRESSED CURRENT CATHODIC CORROSION PROTECTION

FIELD OF INVENTION

This invention relates to an improved oxide anode to be used in impressed current cathodic corrosion protection, such as the cathodic protection of tanks and pipelines in soil, fresh water or sea water, and also in connection with the protection of sheet steel pilings in harbors. Other examples of the fields of use of the present anode are floating docks, high voltage direct current transmissions and large water towers for drinking water. Generally, the anode according to the invention can be used in most instances where traditional anodes can be used. The low price and the low consumption, i.e. loss of anode material, at all current densities as well as the further advantages described in the following render the anode of the present invention an effective and attractive alternative to other anodes.

BACKGROUND OF THE INVENTION AND DESCRIPTION OF THE PRIOR ART

Magnetite anodes for use in impressed current cathodic corrosion protection are known in the art and have proved superior to traditional silicon-iron and graphite anodes which require frequent replacement. Thus, a magnetite anode, the entire inside surface of which is plated with a thin copper layer, and in which just below the anode top a copper plate is fixed to the inside copper layer with a cable connection attachment soldered thereon, has been described and used in practice for cathodic protection of a number of structures susceptible to corrosion. In this context, reference is made to my paper entitled "Magnetite Anodes For Impressed Current Cathodic Protection", presented during "Corrosion/78" (paper 159), March 1978, Houston Tex., and published in "Materials Performance", August 1979, pp. 17–20. The latter reference is believed to contain a description of the prior art coming closest to the present invention as described and claimed herein.

The above-mentioned prior art anodes have a number of disadvantages. Thus, the cable connection attachment at the top of the anode has given rise to problems with respect to the current distribution and hence also as regards the so-called end-effects, i.e. a high load and thus also metal plating attacks at those locations on the anode where an uneven current load is encountered.

Furthermore, when using a copper plating or coating combined with the prior art cable connection attachment, problems with respect to cracks in the magnetite anode were experienced. Thus, when cracks were formed, the electrolyte could penetrate the cracks, and the copper layer disappeared at the crack locations. This caused problems with regard to the current discharge, since at those locations on the anode where the copper layer disappeared, the current could not pass, and hence the remaining part of the anode was unduly highly loaded. Furthermore, an unduly high resistivity was experienced because of the disappearance of the copper layer.

In accordance with the above, it is an object of the present invention to provide an improved oxide anode arrangement for use in impressed current cathodic corrosion protection, thereby providing an anode having a satisfactory even distribution of current therefrom and not being susceptible to end-effects, at the same time avoiding an unduly high anode resistivity.

It is a further object of the invention to provide an improved magnetite anode of the above type which has the above advantages and is simple and cheap in production and practical use.

A still further object of the invention is to provide a magnetite anode of the above type having a coating or plating consisting of lead metal or a lead metal alloy, such anode being particularly effective in operation in impressed current cathodic protection.

Still further objects will be apparent from the following description.

BRIEF SUMMARY AND DESCRIPTION OF THE INVENTION

The invention relates to a metal oxide anode or anode construction for use in impressed current cathodic corrosion protection, said anode comprising a metal oxide anode member having a wall of metal oxide material which is completely or partially coated on one side with an electrically conductive metallic material, and a cable termination member which is fixed in conductive connection to a central area of said coated surface, thus providing contact between the termination member and the coating substantially in the central area of the said coating. The coating may be a metal plating or other type of coating and preferably does not cover the marginal portions of said one side.

The above described central connection serves to obtain a satisfactory even current distribution, and the above-mentioned undesirable end-effects are also highly diminished.

In a specific embodiment of the anode the metal oxide is magnetite, although other metal oxides can also be used, such as a $NiO+FeO/FeO_3$-anode instead of a magnetite anode which is a $FeO/Fe_2O_3$-anode.

More specifically, the invention relates to a magnetite anode for the use stated above, said anode comprising a magnetite anode member which on its current impressing surface is completely or partially coated or plated with an electrically conductive metal or metal alloy selected from the group consisting of copper, lead, tin, aluminum, copper alloys, lead alloys, tin alloys, and aluminum alloys, said coating or plating being connected to an electrically conductive cable termination member which is fixed in conductive connection to a central position or area relative to said coating or plating, thus providing contact with the coating or plating substantially in the center or central area of said coating or plating.

According to the invention, the metal or metal alloy used as the coating or plating material is preferably a lead material such as lead or a lead alloy, for example a lead alloy containing 95% Pb and 5% Sb, or a lead alloy containing lead, tin and zinc. Lead is approximately three times cheaper than copper, and lead is also passive when anodically charged with an electric current. The latter property is important since, as mentioned in the foregoing, when using copper coatings crack problems arise from time to time, i.e. when cracks occur in the magnetite, the copper coating disappears at the place of crack and causes problems with respect to the current discharge in that the current cannot pass where copper has disappeared, and the resistance of the anode is thereby increased to an unacceptable degree. These problems are avoided when using lead or lead alloys or other of the above metals or alloys thereof instead of copper.

The central cable termination member is preferably a bronze spiral which is pressed into the magnetite in such a manner that contact between the metal coating or plating and the spiral is obtained exactly in or substantially in the middle of the anode, thus providing an even current distribution and avoiding undesirable end-effects.

In a preferred embodiment of the invention, the current impressing surface of the magnetite anode member is only partially coated or plated with the electrically conductive metal or metal alloy, since such partial coating may be serve to diminish undesired end-effects.

Thus, according to a specifically preferred embodiment of the invention, there is provided a magnetite anode for use in impressed current cathodic corrosion protection, said anode comprising a magnetite anode member in the form of a hollow and substantially cylindrical tube open at one end and closed at the opposite end, said tube on its current impressing inner surface being coated or plated with lead metal or an electrically conductive lead alloy, said coating or plating covering said inner surface except for a relatively small area at the upper part of said surface at the open end of said tube and except for a corresponding relatively small area at the closed bottom part of said tube, said coating or plating being connected to a conductive cable termination member in the form of a bronze spiral fixed in conductive connection at a central position or area of said coating or plating, thus providing contact between the coating or plating substantially in the center or central area of said coating or plating.

An anode of this type is relatively cheap, and the lead coating or plating serves to avoid damages caused by anode coating cracks, and the lead coating, compared to copper, provides substantially identical current discharges along the whole length of the anode and corresponding voltage decreases.

DESCRIPTION OF THE DRAWING, INCLUDING FURTHER DESCRIPTION OF THE INVENTION

The invention is illustrated in the accompanying drawing which shows a preferred embodiment of a magnetite anode according to the invention. The drawing shows a longitudinal section in a cylindrical anode arrangement.

In the drawing a magnetite anode member 10 is coated or plated with a layer 11, preferably a lead or lead alloy layer, which ends at an upper position 17 and at a bottom position 18. The metal layer 11 is covered with a plastic compound 12 which also covers those inner parts of the magnetite anode member 10 which are not having a metal layer 11. The inside of the tubular anode assembly is filled with a porous body 13, such as expanded polystyrene, and the top of the anode member is closed by means of a plastic cap 16 through which a cable 14 penetrates. A cable to anode center connection 15 is in the form of a bronze spiral having electrical contact with the layer 11.

When using the anode in practice the anode is connected to the positive pole of a direct current supply, whereas the material or construction to be protected against corrosion is connected to the negative pole of said direct current supply. The use of an improved anode as described above, in particular as illustrated in the drawing, is highly attractive in that the advantages described in the foregoing are thereby achieved.

What is claimed is:

1. A magnetite anode for use in impressed current cathodic corrosion protection, said anode comprising a magnetite anode member in the form of a hollow and substantially cylindrical tube open at one end and closed at the opposite end, said tube on its inner surface being coated with an electrically conductive lead material, said coating covering said inner surface except for a relatively small area at the upper part of said surface at the open end of said tube, and except for a corresponding relatively small area at the bottom part of said tube, said coating being connected to a conductive cable termination member in the form of a bronze spiral fixed to contact a central area of the said surface coating, thereby providing contact between the coating substantially in the central area of said coating.

2. A metal oxide anode for use in impressed current cathodic protection against corrosion, comprising a metal oxide anode member having a cavity therein, an electrically conductive coating covering the central portion of the sidewalls of said cavity but not the portions of said sidewalls adjacent the edges thereof, and a cable termination member in contact with only the central area of said coating.

3. The anode of claim 2, wherein said anode member is substantially an elongated cylinder and said cavity is substantially a cylinder coaxial with said anode member, and said coating covers the sidewalls of said cavity cylinder except adjacent the opposite ends thereof.

4. The anode of claim 2, wherein said coating is of a lead material.

5. The anode of claim 2, wherein said anode member is of magnetite.

6. The anode of claim 2, wherein said cable termination member comprises a bronze spiral bearing against said central area.

7. A metal oxide anode for use in impressed current cathodic corrosion protection, comprising a metal oxide anode member having a wall composed of metal oxide material, one side of said wall being partially coated with an electrically conductive metallic material; an electrically conductive cable termination member which is fixed to contact only the central area of said coating; and wherein said coating of metallic material extends over a major portion of said side of said wall, but not over the edge portions of said side of said wall remote from said central area of the coating.

8. A metal oxide anode according to claim 7, in which the anode member is a magnetite anode member.

9. A metal oxide anode according to claim 7 wherein said anode member comprises a hollow elongated anode member and wherein said coating of metallic material extends substantially throughout the inside surface of said hollow elongated anode member, except at the ends thereof.

* * * * *